United States Patent [19]

Golovko et al.

[11] Patent Number: 4,796,398

[45] Date of Patent: Jan. 10, 1989

[54] FOUNDATION OF A BUILDING OR INSTALLATION ERECTED ACROSS A RAVINE EXTENDING ALONG A SLOPE

[75] Inventors: Viktor A. Golovko; Semen P. Valts, both of Yalta; Alexandr M. Lekhno, Simferopol; Alexandr N. Tetior, Simferopol; Boris J. Barykin, Simferopol, all of U.S.S.R.

[73] Assignee: Simferopolsky Filial Dnepropetrovskogo Inzhenerno-Stroitelnogo Instituta, Simferopol, U.S.S.R.

[21] Appl. No.: 82,862

[22] PCT Filed: Sep. 26, 1986

[86] PCT No.: PCT/SU86/00091

§ 371 Date: May 29, 1987

§ 102(e) Date: May 29, 1987

[87] PCT Pub. No.: WO87/02083

PCT Pub. Date: Apr. 9, 1987

[51] Int. Cl.[4] ..... E02D 19/00

[52] U.S. Cl. ..... 52/169.2; 52/169.4

[58] Field of Search ..... 405/107, 114, 110, 286, 405/112; 52/169.4, 169.2

[56] References Cited

U.S. PATENT DOCUMENTS

| | | | |
|---|---|---|---|
| 374,378 | 12/1887 | Strong | 405/107 |
| 815,866 | 3/1906 | Scofield | 405/286 |
| 1,033,988 | 7/1912 | Coburn | 405/112 |
| 1,087,662 | 2/1914 | Jorgensen | 405/112 |
| 1,573,366 | 2/1926 | Zucco | 405/112 |
| 1,898,095 | 2/1933 | Noetzli | 405/114 |
| 2,038,979 | 4/1936 | Baticle | 405/107 |
| 2,420,228 | 5/1947 | Cordon | 405/286 |

FOREIGN PATENT DOCUMENTS

| | | | |
|---|---|---|---|
| 92110 | 1/1922 | Austria | 405/107 |
| 1000531 | 2/1952 | France | 405/284 |
| 101777 | 10/1923 | Switzerland | 405/107 |
| 313330 | 12/1950 | Switzerland | 405/107 |

OTHER PUBLICATIONS

Ross Dam Built in Isolated Skagit Gorge, Engineering News Record, Oct. 12, 1939, pp. 48–52.

G. Klein et al., Bases and Foundations, 3rd edition, Moscow, 1987, p. 104.

M. Makarochkin et al., Industrial Building Foundations, Minsk, 1962, pp. 39, 51.

*Primary Examiner*—Henry E. Raduazo

*Attorney, Agent, or Firm*—Fleit, Jacobson, Cohn & Price

[57] ABSTRACT

A foundation (1) comprises at least one longitudinal wall (4) connected to transversal walls (6) and made arcuate with the camber facing towards a higher ravine point. The foundation (1) is in the form of an arch in the horizontal plane, the end faces of the foundation (1) bearing against the opposite slopes of the ravine.

1 Claim, 2 Drawing Sheets

FOUNDATION OF A BUILDING OR INSTALLATION ERECTED ACROSS A RAVINE EXTENDING ALONG A SLOPE

TECHNICAL FIELD

The invention relates to civil engineering, and in particular, to a foundation of a building or installation erected across a ravine extending along a slope.

BACKGROUND OF THE INVENTION

Masses of such slopes consist of soil layers having non-uniform physico-mechanical properties characterized by complicated engineering geology and hydrogeological conditions are seriously aggravated in seismically active areas where this invention can also be successfully used.

All methods presently used for the development of territories complicated by ravines or hollows are expensive and require considerable amount of materials and labour effort since the structures of up-to-date retainment and landslide protection installations, which are part of a development complex, are mainly used to retain in equilibrium masses of fill soil used for backfilling of a ravine or hollow or to stabilize landslide phenomena and are practically not used as foundations for erecting buildings or installations thereupon.

At the same time, there is an evergrowing shortage of land with flat terrain whose lots are primarily used for agriculture and recreation.

The trends in the development of territories complicated by ravines or hollows show that construction is usually carried out by erecting massive retainment landslide protection installations with the subsequent backfilling of a ravine or hollow.

Retaining wall is one of the widely used retainment structures. There is a great variety of designs of retaining walls which are made of various materials. In most cases, the retaining walls are used for levelling purposes, i.e. the retaining walls back-up comparatively small soil masses from sliding. However, in some cases the retaining walls can be also used under considerably landslide pressures. A crib-type retaining wall is considered to be one of the most economical designs among the structures of this type which are capable of taking-up a considerable horizontal force.

A lattice-type design consisting of vertical reinforced concrete and metal members extending through landslide soils and secured in stable soil layers is considered more rational a design than the retaining walls. The soil between these members performs together with them forming a retainment installation. Among such structures there are piles (precast piles, cast-in-place piles, filled-in piles).

The above mentioned structures are generally loaded by bending. If similar members do not extend through the entire landslide mass but extend only in a sliding plane area, such constructions will be generally loaded with shear.

In some cases it may be preferable to use landslide protection structures such as so-called anchor-and-stays installations. In this case, a slab or a lattice-type structure is placed on the slope surface and secured to stable soil layers by means of flexible tie rods cutting through the body of landslide soils.

To protect embankments and excavations, buttress structures are used which extend along a slope and are disposed at some interval from each other across the slope. The soil between the buttresses form vaults which prevent the landslide mass from pressing through. The buttresses are made of stone, concrete and reinforced concrete.

Also known in the art is a landslide protection structure made in the form of piles which are rigidly interconnected by a pilework bearing against massive abutments. This structure substantially improves static performance of piles and reduces consumption of materials.

Known in the art is a landslide protection structure in which active and landslide soil pressure is taken-up by a combined retaining wall having reinforced concrete arch structures. The retaining wall is in the form of a prism of a stone of crystalline rocks on the outer slope of which there are horizontal reinforced concrete arches disposed at different height and serving to take-up an excessive pressure exerted on the wall. The arches bear against reinforced concrete foundations made in semirock or rock soils of the ravine sides. A disadvantage of this design resides in considerable consumption of materials and high cost caused by the fact that the retaining wall takes-up a landslide pressure only by virtue of friction between the wall and soil bedrocks so that the retaining wall should be of a considerable cross-sectional area. To enhance a load-bearing capacity of the retaining wall under slip, it is necessary that its outer slope be reinforced with reinforced concrete arches. Furthermore, a substantial disadvantage of the retaining wall design resides in underdevelopment of territories complicated by ravines because when this design is utilized it is only possible to backfill the ravine with soil which connot be used as a base for a building or installation because of large non-uniform settlements which occur in backfilling. A lot formed upon the ravine backfilling is used not for erection of buildings but for making sporting grounds, parks, etc., the possibility of using this landslide protection structure as foundation of a building or installation being out of the question.

Known in the art are foundations of buildings or installations erected across ravines extending along slopes.

Generally such foundations consist of vertical longitudinal and transverse walls. When such foundations are erected in ravines, the outer longitudinal wall facing towards a higher ravine point is either in contact with the soil of the ravine backfilling and takesup the horizontal pressure of the backfilling mass or is not in contact with this backfilling.

In the latter case, slope retainment structures are erected which are in the form of retaining walls located in front of the outer wall of the foundation which faces towards a higher ravine point.

In both cases, the soils of the ravine slopes are under the action of the inclined component not only of the weight of the soil of the ravine backfilling but also of the inclined component of the foundation weight and the weight of a buiding erected thereupon.

A substantial disadvantage of such foundations is a considerable shearing action exerted upon weak soils of the ravine bottom which may result in a loss of stability of the ravine bottom soils under the building. Because of this, in designing buildings on such slopes the ravine backfilling weight acting upon the foundation is taken into account. In order to take-up additional shearing loads acting upon the foundation, its walls are reinforced or additional retaining walls are erected which results in a considerably higher amount of materials (concrete, steel) required for erection of a foundation and makes it much more expensive.

The present invention is based on the problem of providing such a foundation of a building or installation erected across a ravine extending along a slope whose design would make it possible to take-up loads caused by landslide pressure while taking-up loads from a building or installation.

SUMMARY OF THE INVENTION

This problem is solved by that in a foundation of a building or installation erected across a ravine extending along a slope, comprising vertical longitudinal and transverse walls, according to the invention, at least one longitudinal foundation wall connected to the transversal walls is made acruate with the camber facing towards a higher ravine point, its end faces bearing against opposite ravine slopes, the foundation being in the form of an arch in the horizontal plane.

The foundation design according to the invention makes it possible to take-up the load from the building along with the horizontal landslide pressure owing to considerable mass of backfillings of the ravine on the side of the convex portion of the arch. The arch form of the foundation is most effective when the foundation is under the action of a horizontal pressure since in this case the arch rise has a direction opposite to that of this pressure. When compared to a conventional retaining wall, the foundation according to the invention is more stable due to a considerable load from the weight of a building erected thereupon. Furthermore, the arch form of the foundation as a construction bearing against two supports, i.e. opposite ravine walls, makes it possible to transform in the base of the horizontal landslide pressure along the ravine into the transversal pressure facing towards the opposite ravine walls. This makes it possible to take-up considerable horizontal landslide pressures from the ravine backfilling and eventual seismic action from the building weight.

The design of an arch foundation loaded by compression, which is the most favourable type of load for concrete, makes it possible to considerably reduce the amount of materials required in the erection of a foundation thus lowering its cost.

Furthermore, the above mentioned transformation of load acting upon the foundation makes it possible to practically eliminate transmission of the load from the building to weak soils of the ravine bottom.

In the preferred embodiment of the invention using two arcuate longitudinal walls having their camber directed towards a higher ravine point, the walls are installed in parallel with each other, the foundation being of a box-shaped cross-section.

Such embodiment of the foundation makes it possible to enhance its load-bearing capacity to take-up horizontal loads caused by the landslide pressure of the soil on the foundation wall which is in contact with the levelled ravine slope.

In another embodiment of the invention, transversal walls connected to a longitudinal wall are substantially parallel with each other and are inscribed in an imaginary rectangle in the plan view.

This embodiment of the invention makes it possible to erect a building the form of which does not depend on the form of an arch foundation. Furthermore, in case of weak soils in the area of contact between the foundation end faces and the ravine slopes this embodiment allows the tying-up of the arch (i.e. the interconnection of its ends) to be made within the plan outlines of the building.

BRIEF DESCRIPTION OF THE DRAWINGS

Other objects and advantages of the present invention will become apparent from the following detailed description, when taken in conjunction with the accompanying drawings, in which.

BEST MODE FOR CARRYING OUT THE INVENTION

Figure 1:
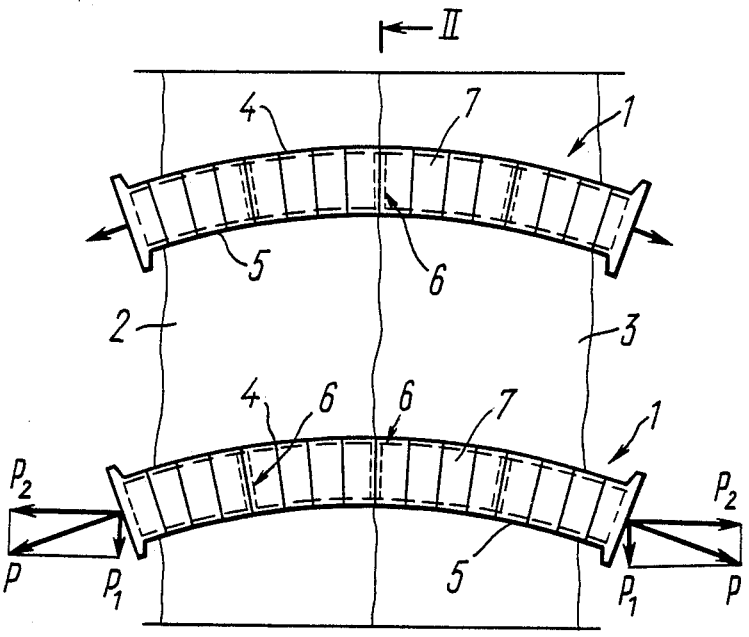
FIG. 1 illustrates a plan view of a foundation of a building or installation, according to the invention.

A foundation 1 (FIG. 1) is installed across a ravine and is of a box-shaped cross-section. The end faces of the foundation 1 bear against opposite slopes 2, 3 of the ravine, the foundation 1 comprising two upright arcuate longitudinal walls parallel with each other, namely an external wall 4 and an internal wall 5 having its camber directed towards a higher ravine point. The foundation 1 is in the form of an arch in the horizontal plane. The walls 4 and 5 are interconnected with each other by transversal vertical walls 6 and floors 7. The external wall 4 is in contact with the levelled ravine slope to function as retaining wall and to keep the ravine soil disposed behind the wall 4 in the equilibrium condition. The walls 4 and 5 may be prefabricated or cast-in-place. The choice of the walls mainly depends on the load taken-up by the foundation 1 and economical considerations.

When a horizontal pressure is applied to the wall 4, it is transmitted through the wall 6 and floors 7 to the wall 5. Furthermore, the walls 4 and 5 are also under the vertical pressure from the building weight. Due to this, it is possible to considerably reduce thickness of the walls 4, 5 and 6. With considerable vertical loads under the walls 4 and 5, considerable stresses develop in the soil. To reduce these stresses, spreading pads 8 may be installed under the walls 4 and 5.

When the foundation of a building or installation is under a horizontal load P, the force which is applied to the end faces of the arch 1 is decomposed into two components, one component $P_1$ being parallel to the slope 2, 3 of the ravine and the other component $P_2$ being directed across the slope.

The walls 4, 5 and 6 and the floors 7 form a hollow structure whose interior may be used, e.g. for accommodation of garages or other purposes.

Figure 2:
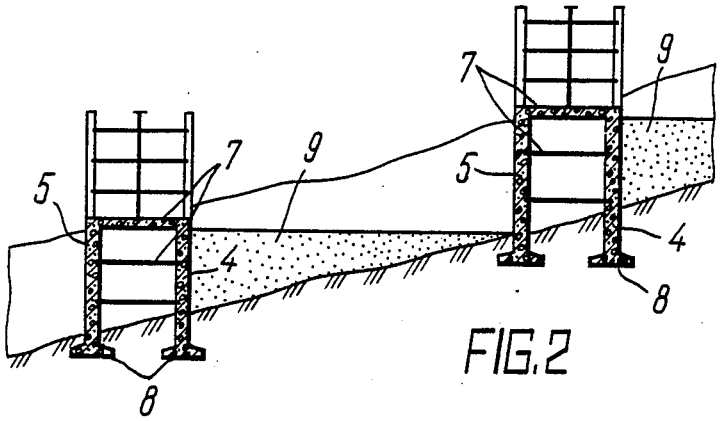
FIG. 2 is a sectional view taken along line II—II in FIG. 1.

When several buildings are erected along the ravine, the backfilling of a terrace 9 (FIG. 2), e.g. for sporting grounds or for placing engineering lines may be carried out between the buildings. The terrace 9 may also be erected when only one building is constructed along the ravine.

Erection of the structures is carried out in the following order: first, excavation of the soil of the base for the walls 4 and 5 is carried out, the walls 4 and 5 are then erected with concurrent erection and concreting of the walls 6.

Figure 3:
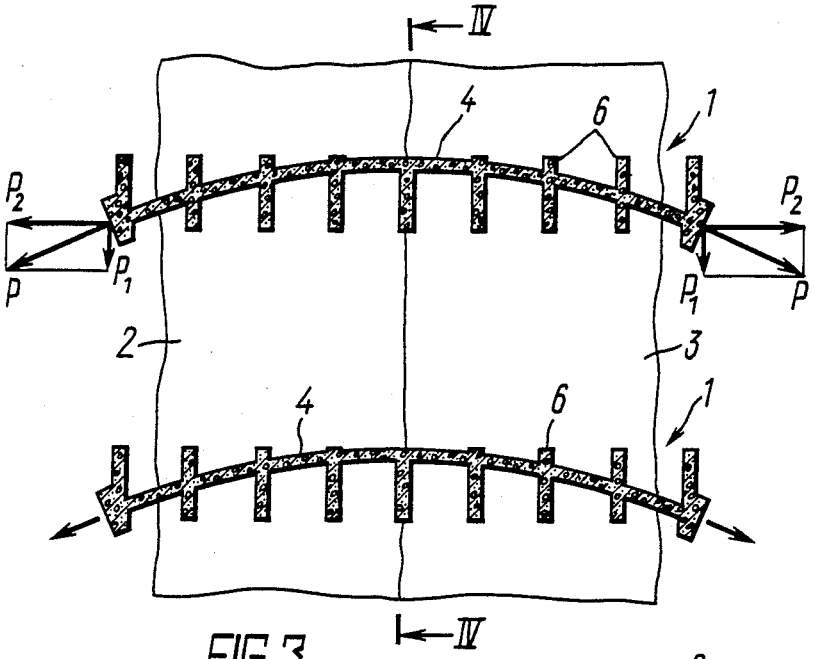
FIG. 3 is a plan view of an embodiment of a foundation of a building or installation, according to the invention.
Figure 4:
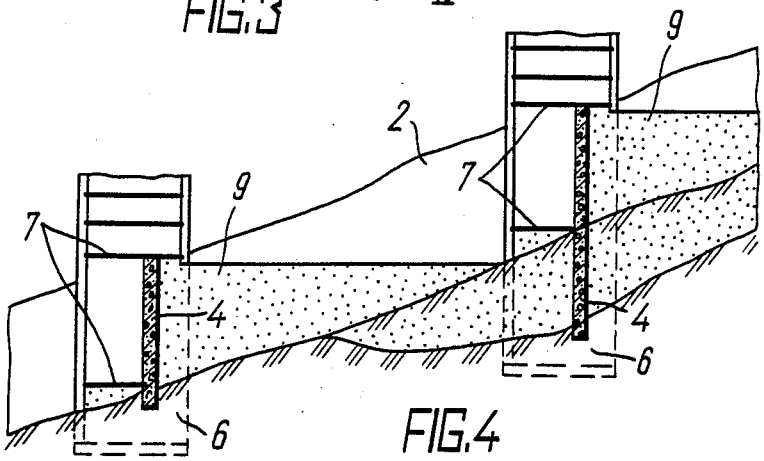
FIG. 4 is a sectional view taken along line IV—IV in FIG. 3.

FIGS. 3, 4 show an embodiment of a foundation according to the invention in which a foundation 1 comprises one longitudinal vertical wall 4 connected to transversal vertical walls 6 disposed substantially in parallel with each other. The walls 6 are inscribed in an imaginary rectangle in the plan view. The length of the foundation 1 may be equal to the length of the building, longer or shorter than the building. The value of the rise of the arch foundation 1 may be equal to, greater or less than the width of the building. The building may be erected either continuously or in an interrupted fashion along the foundation 1.

In the design according to the invention, the foundation 1 is buried in the base and the transversal walls 6 disposed at the end faces of the wall 4 bear against the slopes 2, 3 of the ravine and are buried in them. The walls 4, 6 may be prefabricated or cast-in-place depending on the load and economical considerations.

To minimize shearing forces at the base, the design may involve the foundation 1 which is not buried in the bedrock. Under the horizontal pressure from the backfilling and the walls 6 exerted on the foundation 1, compressive forces develop in the foundation 1 which are transmitted by the end faces of the foundation 1 to the slopes 2, 3 of the ravine. In case of weak soils of the slopes 2, 3 of the ravine which are not capable of taking-up a strong thrust from the foundation 1, its tying-up can be carried out within the plan outlines of the building.

In spanning the walls 6 spaces are formed which can be used to accommodate, e.g. garages.

Erection of structures is carried out in the following order.

First, levelling of the base for the foundation 1 is carried out. The foundation 1 is then erected or concreted. The floors 7 are then installed in the space between the walls 6 and the structures are erected above the foundation of the building or installation.

INDUSTRIAL APPLICABILITY

The present invention may be most effectively used in the development of nonused territories or territories of limited use complicated by ravines or hollows.

We claim:

1. A foundation of a building or installation erected across a ravine extending along a slope and having face ends bearing against opposite slopes of the ravine, said foundation comprising a vertically extending longitudinal wall and vertically extending transverse walls connected to said longitudinal wall, said longitudinal wall being arcuate with a camber facing towards a higher ravine point, characterized in that said transverse walls are substantially parallel with each other and are inscribed in an imaginary rectangle in the plan view.

* * * * *